US008397937B2

(12) United States Patent
Preschke et al.

(10) Patent No.: US 8,397,937 B2
(45) Date of Patent: Mar. 19, 2013

(54) ARTICLE CARRIER WITH A DIVIDING ARRANGEMENT

(75) Inventors: Harald Preschke, Vohrigen (DE); Wolfgang Kollmann, Pfaffenhausen (DE); Stefan Hehl, Bad Saulgau (DE)

(73) Assignee: KARDEX Produktion Deutschland GmbH, Neuburg/Kammel (DE)

( * ) Notice: Subject to any disclaimer, the term of this patent is extended or adjusted under 35 U.S.C. 154(b) by 340 days.

(21) Appl. No.: 12/669,749

(22) PCT Filed: Jul. 20, 2008

(86) PCT No.: PCT/EP2008/005938

§ 371 (c)(1),
(2), (4) Date: Jul. 11, 2010

(87) PCT Pub. No.: WO2009/012951

PCT Pub. Date: Jan. 29, 2009

(65) Prior Publication Data

US 2010/0301052 A1 Dec. 2, 2010

(30) Foreign Application Priority Data

Jul. 20, 2007 (DE) ..... 20 2007 010 297 U

(51) Int. Cl.
*B65D 1/24* (2006.01)

(52) U.S. Cl. ..... 220/529; 220/528; 29/412; 29/428; 29/525.01; 312/348.3; 211/184; 403/217; 160/131

(58) Field of Classification Search ..... 220/528, 220/529; 160/31; 211/184; 312/348.3; 29/412, 29/428, 525.01; 403/217
See application file for complete search history.

(56) References Cited

U.S. PATENT DOCUMENTS

| | | | | |
|---|---|---|---|---|
| 1,893,186 | A | 1/1933 | Thomas, Jr. et al. | |
| 4,362,251 | A | 12/1982 | Marling | |
| 6,871,921 | B2 * | 3/2005 | Ernst | 312/348.3 |
| 6,928,711 | B1 | 8/2005 | Sunka | |
| 2008/0295976 | A1 * | 12/2008 | Watanabe | 160/131 |

FOREIGN PATENT DOCUMENTS

| | | | |
|---|---|---|---|
| DE | 875857 | | 5/1953 |
| DE | 69025714 | T2 | 9/1996 |
| DE | 69517031 | T2 | 12/2000 |
| DE | 10004232 | A1 | 8/2001 |
| DE | 20304159 | U1 | 5/2003 |

(Continued)

OTHER PUBLICATIONS

International Search Report for PCT/EP2008/005938, 6 pages, dated Nov. 17, 2008.

*Primary Examiner* — Anthony Stashick
*Assistant Examiner* — Elizabeth Volz
(74) *Attorney, Agent, or Firm* — Edell, Shapiro & Finnan LLC

(57) ABSTRACT

In order to provide an article carrier with a dividing arrangement (9) which is flexible in terms of height, rests on the base (8) of the article carrier and has profiled side walls (70, 71) with undercut grooves (76) running parallel to the base (8), and has at least one partition wall (70, 71; 80) for inserting between the side walls (70, 71) and right-angled corner connectors (20) which can be latched into the grooves (76), it is proposed that the side walls (70, 71) have an undercut projection on their top side or their bottom side, and a latching profile for latching with the projection on their bottom side or top side.

16 Claims, 4 Drawing Sheets

FOREIGN PATENT DOCUMENTS

Figure 1:
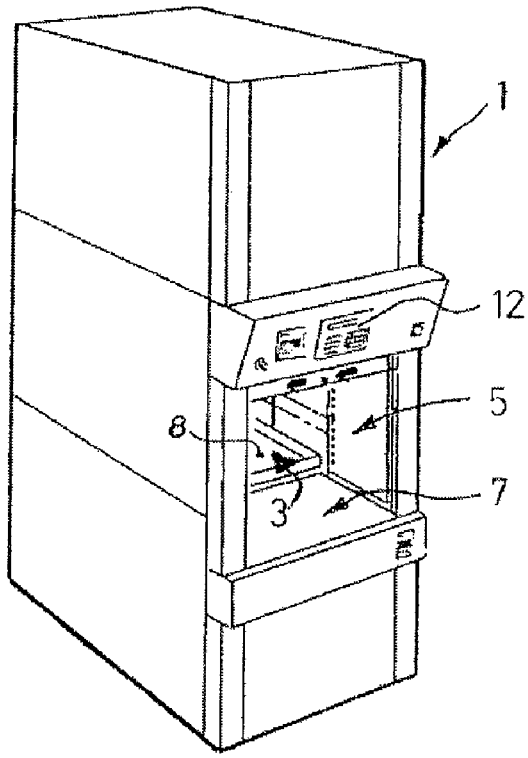

| | | | |
|---|---|---|---|
| EP | 0431100 | B1 | 3/1996 |
| EP | 0773727 | B1 | 5/2000 |
| EP | 1166678 | A1 | 1/2002 |
| WO | 90/15906 | | 12/1990 |

* cited by examiner

ARTICLE CARRIER WITH A DIVIDING ARRANGEMENT

The invention relates to an article carrier according to the preamble of claim 1.

Such an article carrier is known from US 2004/0145287 A1. Here, the side walls do not only comprise a lower groove located in the main surface and running in parallel to the base, but additionally an upper groove running at the top side of the side walls. At the corners, the side walls are connected with each other by means of angled corner connectors which extend over the complete height of the side wall. At the upper end of each corner connector, there is a projection which engages in the upper groove from above, and a further projection engages laterally in the lower groove under tensile stress. These corner connectors can thus be clipped to the side walls. For attaching partition walls, T-shaped connection elements are provided which are put onto the respective partition wall and grip around it, engage with respective projections in the lower grooves of the partition wall on both sides and engage in the upper groove of the side wall from above with a further projection.

Though with such an arrangement rattling which almost necessarily occurs in many other dividing arrangements is eliminated. This dividing arrangement does not permit any flexibility with respect to its height. Inserting this dividing arrangement in an article carrier having larger dimensions than permitted by the delivered length of the dividing arrangement is neither possible.

The object underlying the present invention is to provide an article carrier with a dividing arrangement which permits maximum flexibility with respect to the usable dimensions—in particular with respect to height.

This object is achieved with an article carrier according to claim 1. Advantageous further developments of the invention are the subject matter of the depending subclaims.

According to the invention, it is thus possible to build a dividing arrangement for an article carrier from a few side walls and corresponding corner connectors in a simple way and without any tools by latching or clipping the individual components together. Due to the fact that the side walls comprise a latching projection with an undercut at their top sides (or as an alternative at their bottom sides) onto which a corresponding side wall having a corresponding latching profile at its bottom side (or at its top side, respectively) can be clipped, the article carrier can be equipped with a dividing arrangement in a modular manner according to the invention. As dividing walls, either further profiled side walls or else partition walls without profile can be clipped in.

Figure 2:
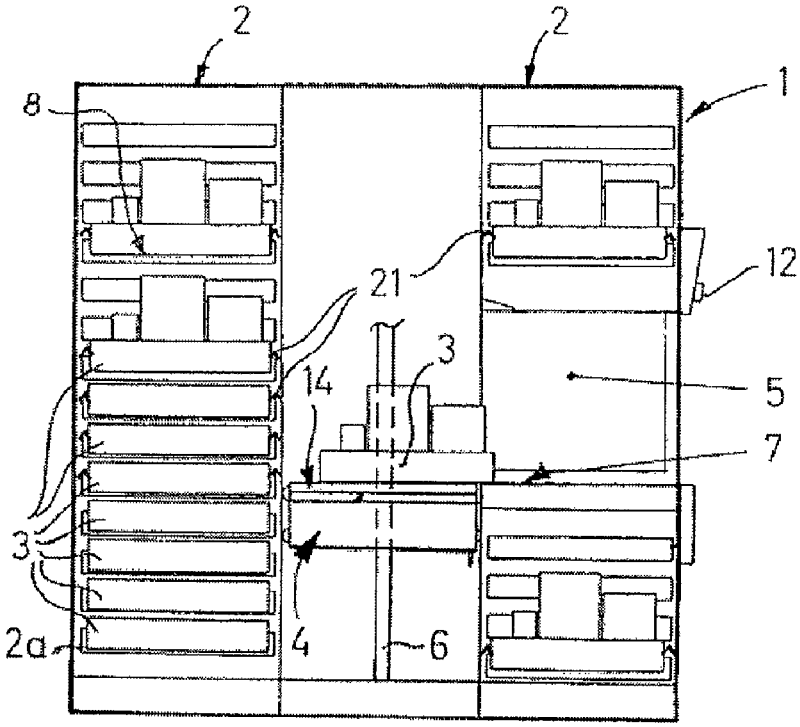
Figure 3:
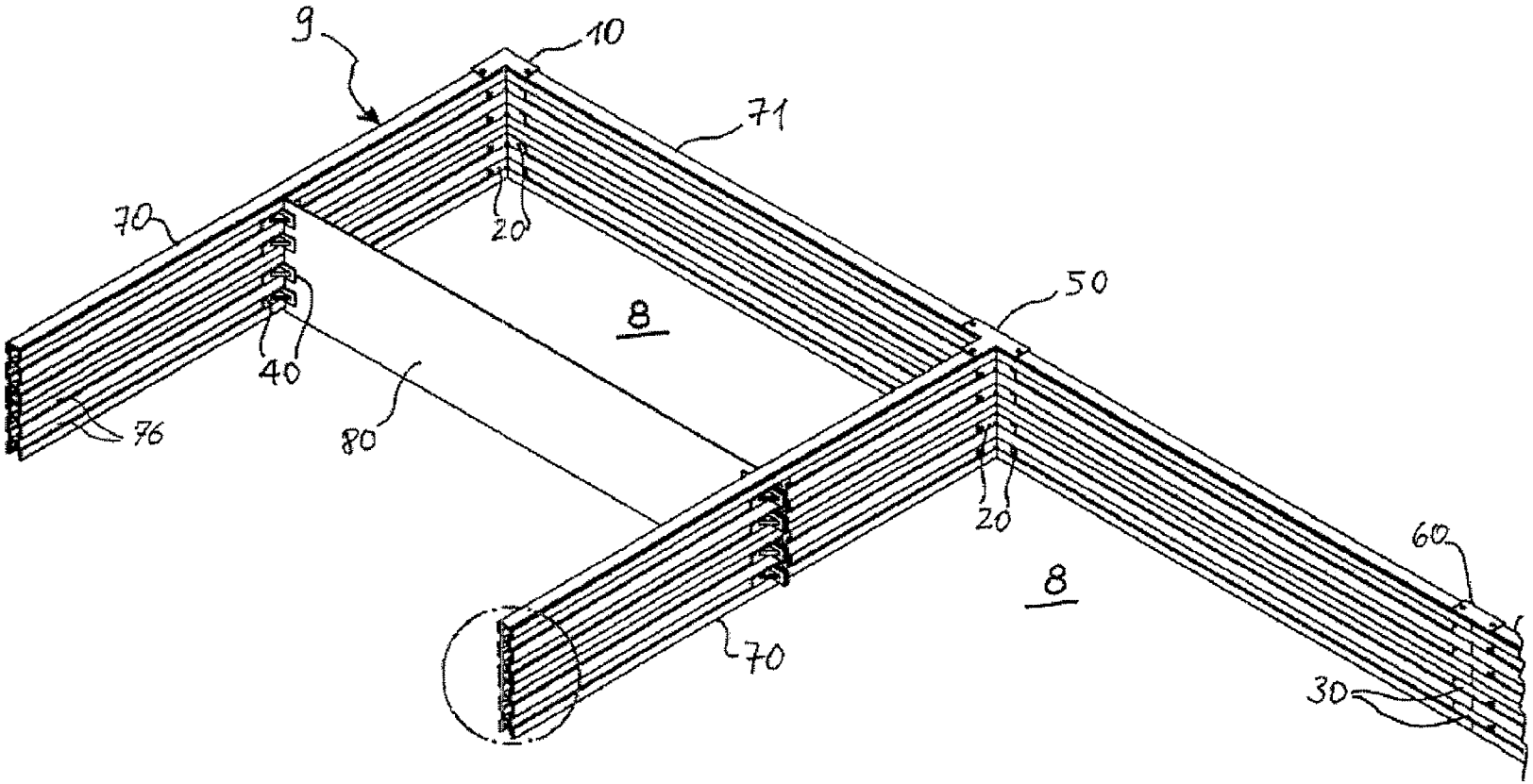
Figure 4:
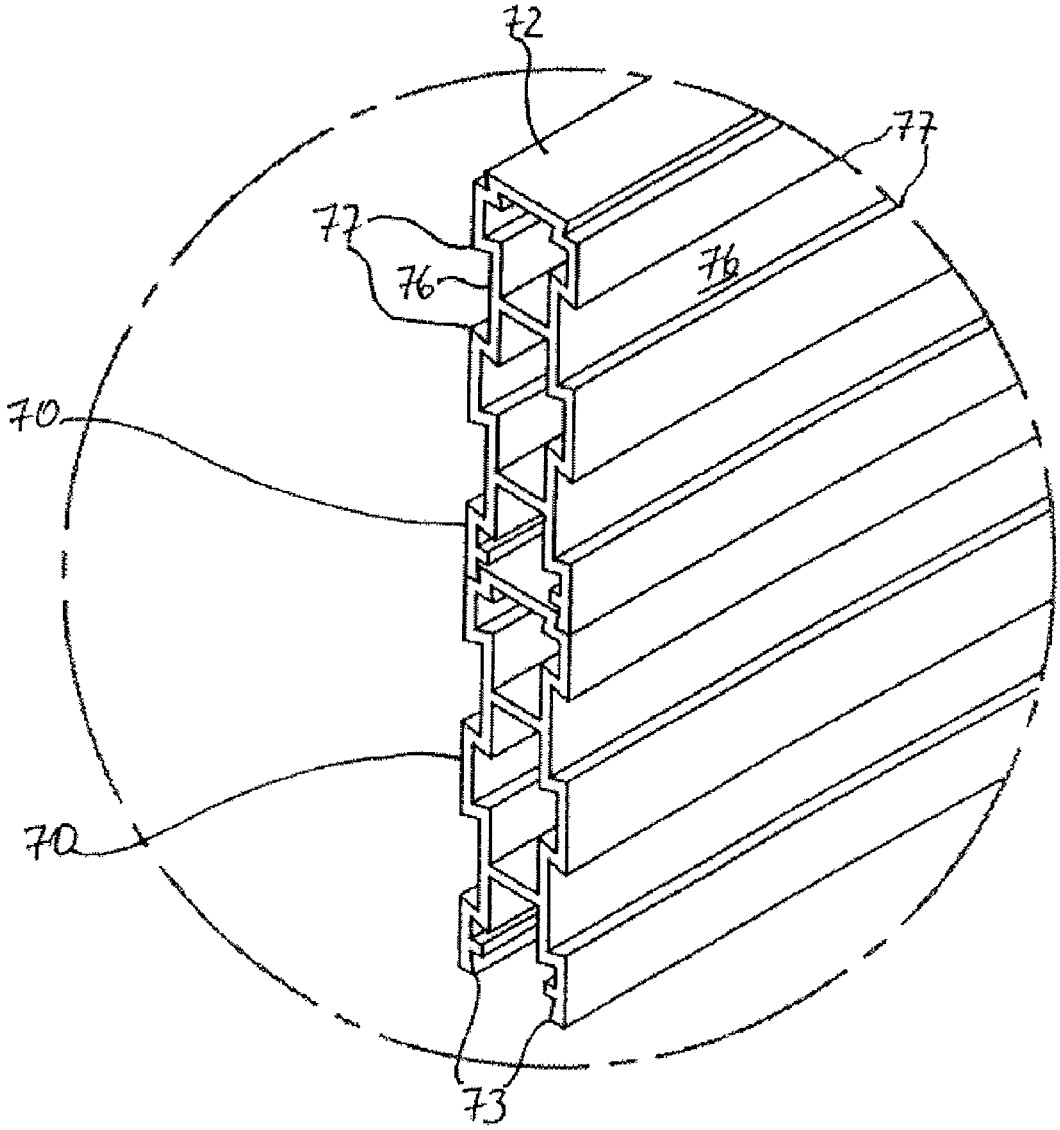
Figure 5:
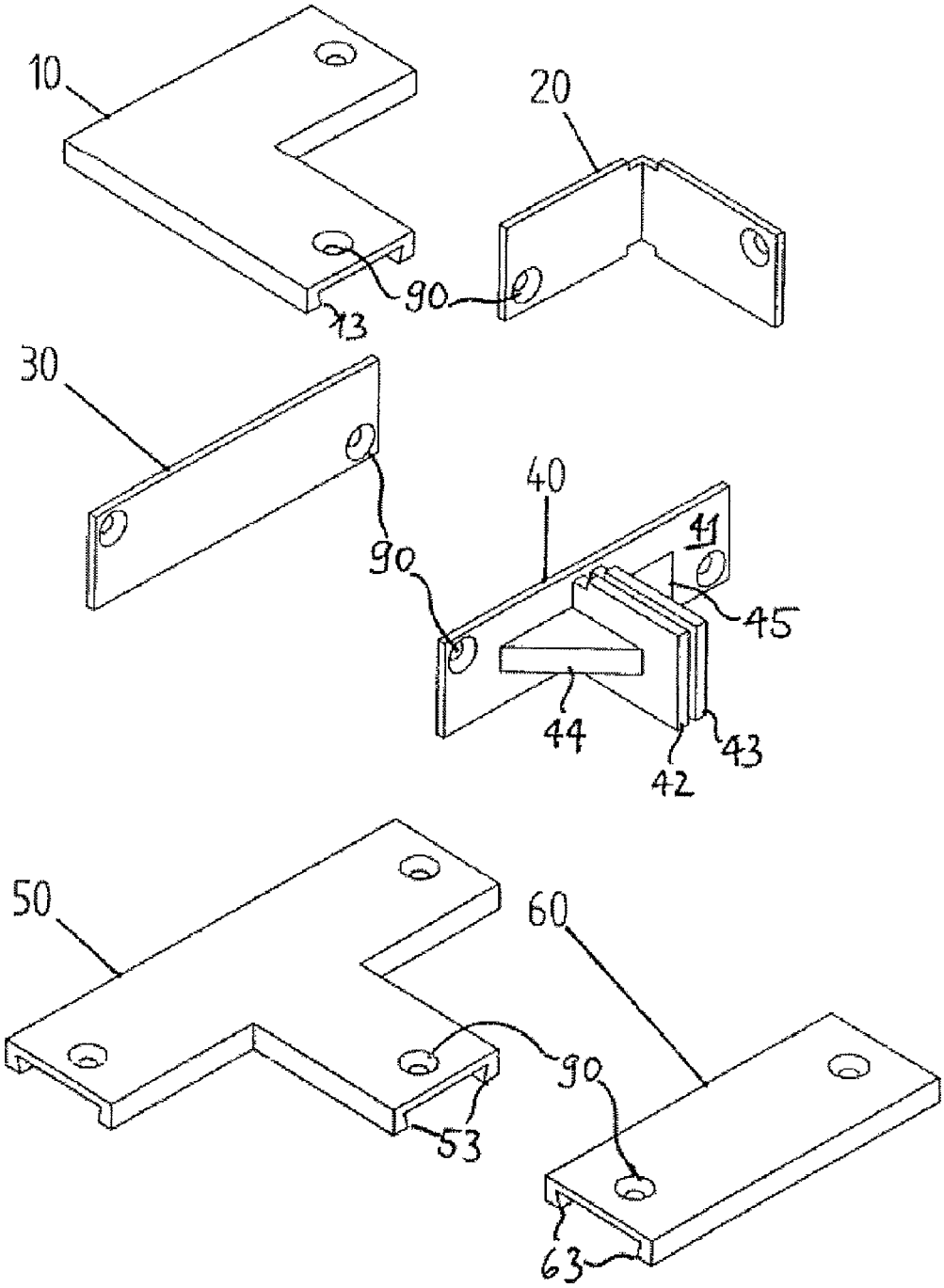

Further advantages, features and particularities of the invention can be taken from the following description of preferred, however not restricting embodiments of the invention with reference to the schematic drawing which is not drawn to scale. In the drawings:

FIG. 1 shows in a perspective representation a storage device in which the article carrier according to the invention is to be employed, FIG. 2 shows a sectional representation of the storage device according to FIG. 1, FIG. 3 shows a perspective representation of a part of a preferred embodiment of the dividing arrangement according to the invention, FIG. 4 shows a detailed view of the profile of the side walls corresponding to the circle in FIG. 3, and FIG. 5 shows an enlarged representation of the assembly parts of the dividing arrangement according to the invention.

In FIG. 1, a perspective representation of a storage device 1 in the form of a mechanical cabinet is shown which essentially consists of two shelf frames 2 arranged one behind the other (also see FIG. 2) in which a plurality of relatively flat, case-like article carriers 3 provided with a base 8 can be stored on lateral support angles 2*a*. The article carriers 3 having a size of up to one square meter or even more are here picked up from a stock deposition/removal opening 5 by a feeder platform 4 and transported to the respective compartment in the shelf frame 2. Stock removal is here accomplished in the opposite way by pulling the respective article carrier 3 from corresponding support angles 2*a* to a predetermined place of the shelf frame 2, moving it then from the feeder platform 4 to the stock deposition/removal level 7 of the stock deposition/removal opening 5 and pushing it then out and into the same. The control of stock deposition or removal, respectively, is here generally effected processor-controlled by means of a drive device, where the control part is, for example, placed behind an operator panel 12 represented schematically here by which predetermined compartment spaces in the shelf frame 2 can be selected. Here, in the region of the stock deposition/removal opening 5, a height sensor can also be provided which detects the height of the article carrier 3 to be stored, where then a corresponding position in the shelf frame 2 is allocated to the same. Thereby, the utilization of the storage area in the storage device 1 is increased.

For stock deposition/removal of the respective article carriers 3, at the top side of the feeder platform 4 e.g. chain drives 14 are provided by means of which the respective article carriers 3 can be taken from the stock deposition opening 5 or pushed out onto the same. To be able to here engage with the respective article carrier 3, for example a front or rear engagement profile 21 (only indicated at some article carriers 3 by one hook each) for the chain drives 14 is provided, as is shown in FIG. 2 as a sectional representation of the storage device 1 according to FIG. 1. Here, in particular the arrangement of the two shelf frames 2 and the feeder platform 4 can be seen by means of which, after the insertion by hand, by means of a robot or any other shelf servicing apparatus, of an article carrier 3, the article carriers 3 can be moved at the allocated storage space in the shelf frame 2. This is accomplished by vertical movement of the feeder platform 4 e.g. by means of an endless rope line. The platform is here vertically guided at a guide rail 6.

In FIG. 3, a part of a preferred embodiment of a dividing arrangement 9 in accordance with the invention intended for an article carrier 3 is shown in a perspective view. The dividing arrangement 9 comprises profiled side walls 70, 71 which are connected to each other at right angles. According to this embodiment, the profile of the side walls 70, 71 is mirror-symmetrical; however, this can be different in other embodiments. The side walls 70, 71 comprise grooves 76 running in the longitudinal direction. The grooves 76 each comprise an undercut, i.e. the distance between the two groove edges 77 defining the groove opening is smaller than the groove base. If two side walls 70, 71 are to be connected to each other at right angles, corner connectors 20 (cf. FIG. 5) are latched or clipped into the grooves 76. Naturally, the corner connectors 20 can be instead laterally shifted into the grooves (from the end of these) without any latching operation—if the assembly state still permits to do so. In this manner, four side walls 70, 71 can be connected to form the outside wall of a dividing arrangement 9 lining an article carrier 3. The corner profile formed in the process is very exact.

As can be seen in the detailed view of FIG. 4, two side walls 70 can be arranged one upon the other by clipping a corresponding latching profile 73 at the lower end of a side wall 70 onto a corresponding undercut latching projection 72 at the top side of another side wall 70. The latching projection 72 here runs in the vertical direction of the side wall 70, 71. In this manner, it is sufficient to produce side wall profiles with two or three different heights and to join them then by appropriate combination to reach a desired total height.

By inserting partition walls 80 into the side walls 70, 71 of the outside wall, a first division can be created. For this, T-shaped side wall connectors 40 are used which comprise a plane section 41 for clipping into the grooves 76. Perpendicularly to the plane section 41, two sections 42, 43 are fixed in parallel to each other at a distance by means of two angles 44, 45. In the distance between the sections 42, 43, then a cheaply to be manufactured thin partition wall 80 without profile can be inserted. In the embodiment according to FIG. 3, four side wall connectors 40 per partition 80 are inserted in each side wall 70, depending on the situation, however, more or less side wall connectors 40 can be used. As an alternative, however, it is of course also possible to insert, instead of a partition wall 80 without profile, a profiled side wall 70 or 71, respectively, using corner connectors 20. This then offers an additional possibility of division by inserting a further side wall 71 or partition wall 80 in the already divided area.

Two side walls 70 and/or 71 can also be connected to each other in a straight line by latching plane connection elements 30 into the grooves 76 of the two side walls to be connected.

In this manner, the complete dividing arrangement 9 has a modular design, and this in terms of height as well as in terms of the length of the respective side wall profiles. Thus, only a few different individual parts have to be manufactured to nevertheless achieve a high variability of the dividing arrangement 9. The higher piece numbers that can be achieved thereby have an advantageous effect on production costs.

Further stabilization and an optically more attractive design of the dividing arrangement 9 are achieved if cover elements 10, 50, 60 for covering the connection points between individual side walls 70, 71 and/or partition walls 80 are used.

It becomes clear from the above description that the assembly of a correspondingly configured dividing arrangement 9 is very easily and quickly possible and does not pose any problems even to untrained users. Due to the soft, resilient undercut of the respective grooves and latching profiles, thus an uncomplicated assembly and/or change of the already assembled dividing arrangement 9 is enabled at all times, where the profile only slightly deforms elastically and reversibly during clipping together or clipping apart. The latching profiles 13, 53 and 63 of the cover elements 10, 50 and 60, respectively, here have a design similar to that of the latching profile 73 of the side wall 70.

The side walls can be manufactured by a continuous casting process from plastics or metal and are thus inexpensive. The corner connectors 20, connection elements 30 and side wall connectors 40 as well as the cover elements 10, 50, 60 can be made of plastics or metal as well.

It is an advantage that the dividing arrangement can be assembled in a corresponding article carrier 3 or a drawer. Here, the dividing arrangement 9 can be assembled from very few individual parts for the most diverse heights and different dimensions. In particular the possibility of being able to connect the profiles in the longitudinal direction permits advantageous stock dimensions—as for example in the shipping stock—and shipping dimensions. Thereby, standardized packages can be used, which does not only have a positive effect on the price, but also on delivery times. Moreover, the dividing arrangement 9 can be subsequently changed, in particular expanded, at all times, thereby further increasing flexibility. Moreover, it is possible for the customer to cut the profiles into sections himself, which also permits the use in non-standardized fields.

It is finally possible, in case of greater demands on the stability of the corner connectors 20, 10, to fix the connection elements 30, the side wall connectors 40 as well as the cover elements 10, 50, 60 at the side walls 70, 71 and the partition walls 80 by means of screws, in particular self drilling screws. Here, holes 90 are advantageously provided in these parts.

It should be noted that the features of the invention described with reference to individual embodiments, such as for example the embodiment of the profile of the side walls as well as the other components of the dividing arrangement, can be also present in other embodiments, unless stated to the contrary.

The invention claimed is:

1. An article carrier (3), comprising a dividing arrangement (9) inserted in the article carrier (3), resting on a base (8) of the article carrier (3), the dividing arrangement comprising:

profiled side walls (70, 71) with main surfaces, at least one of the main surfaces comprising undercut grooves (76) running in parallel to the base (8);

at least one partition wall (70, 71, 80) for insertion between the side walls (70, 71); and right-angled corner connectors (20) which can be latched into the grooves (76) for connecting the side walls (70, 71) with each other, wherein a top side or a bottom side of the side walls (70, 71) comprises an undercut projection (72) and wherein the bottom side or the top side, respectively, comprises a latching profile (73) for latching with the projection (72).

2. An article carrier (3) according to claim 1, wherein at least one of the corner connectors (20) is provided with holes (90) for additionally fixing these parts by self drilling screws.

3. An article carrier (3) according to claim 1, further comprising cover elements (10, 50) which are latchable to the top side of the side walls (70, 71) for covering corner connection points where the side walls (70, 71) are connected to each other or where the side walls (70, 71) are connected to the partition wall (80) respectively.

4. An article carrier (3) according to claim 3, wherein at least one of the cover elements (10, 50) is provided with holes (90) for additionally fixing these parts by self drilling screws.

5. An article carrier (3) according to claim 3, wherein at least one of the grooves (76), the latching profile (73) and cover elements (10, 50) are embodied with a soft, resilient undercut such that at least one of the projection (72) and the corresponding corner connectors (20) as well the cover elements (10, 50) can be latched in and out elastically and reversibly.

6. An article carrier (3) according to claim 1, wherein plane connection elements (30) are provided for connecting two of the side walls (70, 71) in a straight line, wherein the plane connection elements (30) are latchable into the grooves (76).

7. An article carrier (3) according to claim 6, wherein at least one of the connection elements (30) is provided with holes (90) for additionally fixing these parts by self drilling screws.

8. An article carrier (3) according to claim 6, wherein at least one of the grooves (76), the latching profile (73) are embodied with a soft, resilient undercut such that at least one of the projection (72) and the corresponding corner connectors (20) as well the connection elements (30) can be latched in and out elastically and reversibly.

9. An article carrier (3) according to claim 1, wherein cover elements (60) are provided for covering longitudinal connection points of the side walls (70, 71) with each other, and wherein the cover elements (60) are latchable to the top side of the side walls (70, 71).

10. An article carrier (3) according to claim 9, wherein at least one of the cover elements (60) is provided with holes (90) for additionally fixing these parts by self drilling screws.

11. An article carrier (3) according to claim 9, wherein at least one of the grooves (76), the latching profile (73) and cover elements (60) are embodied with a soft, resilient undercut such that at least one of the projection (72) and the corresponding corner connectors (20) as well the cover elements (60) can be latched in and out elastically and reversibly.

12. An article carrier (3) according to claim 1, wherein each partition wall (80) is embodied without a profile, wherein side wall connectors (40) for connecting the partition wall (80) with the side walls (70, 71) are provided, and wherein the side wall connectors (40) comprise a plane section (41) for latching into the grooves (76) and two sections (42, 43) arranged perpendicularly with respect to the plane section (41) and in parallel at a distance to each other for holding the partition (80).

13. An article carrier (3) according to claim 12, wherein at least one of the side wall connectors (40) is provided with holes (90) for additionally fixing these parts by self drilling screws.

14. An article carrier (3) according to claim 12, wherein at least one of the grooves (76) and the latching profile (73) are embodied with a soft, resilient undercut such that at least one of the projection (72) and the corresponding corner connectors (20) as well the side wall connectors (40) can be latched in and out elastically and reversibly.

15. An article carrier (3) according to claim 12, wherein at least one of the side wall connectors (40) is provided with holes (90) for additionally fixing these parts by self drilling screws.

16. A dividing arrangement (9) for an article carrier (3), the dividing arrangement (9) comprising:

profiled side walls (70, 71) comprising undercut grooves (76) in at least one of a plurality of main surfaces of the side walls (70, 71) running in parallel to a bottom side of the side walls (70, 71), at least one partition wall (70, 71, 80) for insertion between the side walls (70, 71), and right-angled corner connectors (20) which can be latched into the grooves (76) for connecting the side walls (70, 71) with each other, wherein a top side or a bottom side of the side walls (70, 71) comprise an undercut projection (72), and wherein the side walls (70, 71) comprise a latching profile (73) at their bottom side or top side for latching with the projection (72).

* * * * *